United States Patent [19]

Chillier-Duchatel et al.

[11] 4,102,757

[45] Jul. 25, 1978

[54] ELECTROCHEMICAL OXYGEN PRODUCTION METHOD

[75] Inventors: Nicole Chillier-Duchatel, Sevres; Bernard Verger, Chevreuse, both of France

[73] Assignee: Societe Generale de Constructions Electriques et Meccaniques "Alsthom et Cie", Paris, France

[21] Appl. No.: 731,696

[22] Filed: Oct. 12, 1976

[30] Foreign Application Priority Data

Oct. 29, 1975 [FR] France ..... 75 33082

[51] Int. Cl.[2] ..... C25B 3/04; C25B 1/02

[52] U.S. Cl. ..... 204/73 R; 204/129

[58] Field of Search ..... 204/73 R, 129

[56] References Cited

U.S. PATENT DOCUMENTS 3,658,667 4/1972 Cobb et al. ..... 204/73 R

FOREIGN PATENT DOCUMENTS 1,257,758 1/1968 Fed. Rep. of Germany.

*Primary Examiner*—R. L. Andrews

*Attorney, Agent, or Firm*—Flynn & Frishauf

[57] ABSTRACT

The invention relates to a method and an electrochemical device capable of producing very pure oxygen. Air is made to react with a reduced form of anthraquinone 2-7 sodium disulphonate in order to obtain a peroxide of this compound which decomposes to an oxidized form and to hydrogen peroxide or water depending on the pH value of the medium, said hydrogen peroxide being decomposed to water, and the water being electrochemically oxidized thus releasing the oxygen, while said oxidized form is electrochemically reduced. The invention is used for the production of very pure oxygen suitable for purifying used water.

14 Claims, 3 Drawing Figures

ELECTROCHEMICAL OXYGEN PRODUCTION METHOD

The present invention relates to an electrochemical oxygen production method.

It also relates to a device for the application of said method.

The method of producing oxygen by electrolysis of water is well known.

Such a method, however, requires a high consumption of electric energy and furthermore the resulting oxygen still contins a small quantity of hydrogen. In a case where it is desired to obtain pure oxygen, it is therefore necessary to remove the hydrogen by making it, for instance, pass through a porcelain tube filled with red hot fragments of the same material in which the hydrogen is transformed into a small quantity of water.

Also, the concommitant production of hydrogen during water electrolysis is a substantial safety problem.

The present invention enables the drawbacks of the known methods to be remedied. According to a first variant of the present invention there is provided an electrochemical oxygen production method, comprising the following sequence of steps:

a first step in which air is made to react, in a slightly basic medium having a pH value of 7 to 10, with the reduced form of a compound in order to obtain a peroxide capable of spontaneously decomposing into water and into the oxidized form of the compound;

a second step in which said water is electrochemically oxidized so that oxygen is liberated; and a third step in which said oxidized form is electrochemically reduced in order to regenerate said reduced form of the compound.

According to a second variant of the present invention there is provided an electrochemical oxygen production method comprising the following sequence of steps:

a first step in which air is made to react, in a basic medium having a pH value of about 14, with the reduced form of a compound in order to form a peroxide capable of spontaneously decomposing into hydrogen peroxide and into the oxidized form of said compound;

an intermediate step in which said hydrogen peroxide is decomposed into water and oxygen;

a second step in which said water is electrochemically oxidized so that oxygen is liberated; and a third step in which said oxidized form is electrochemically reduced to regenerate said reduced form of the compound.

The present invention also provides a first variant of a device for the application of the method, the device comprising an oxidation reaction chamber where the air oxidizes the reduced form of said compound in order to form a peroxide capable of spontaneously decomposing into water and into the oxidized form of said compound;

an electrolyzer having an anode and a cathode separated by a semi-permeable membrane defining an anodic compartment and a cathodic compartment disposed to receive the products leaving said reactor chamber, said anodic compartment being suitable for electrochemically oxidizing the water so that oxygen is liberated, said cathodic compartment being suitable for electrochemically reducing said oxidized form of the compound so that said reduced form is regenerated.

A second variant of the device for applying the method comprises an oxidation reactor chamber where the air oxidizes the reduced form of the compound in order to form a peroxide capable of spontaneously decomposing into hydrogen peroxide and the oxidized form of the compound;

a decomposition chamber where said hydrogen peroxide decomposes into water and oxygen;

an electrolyzer having an anode and a cathode separated by a semi-permeable membrane defining an anodic compartment and a cathodic compartment disposed to receive the products leaving said decomposition chamber, said anodic compartment being suitable for electrochemically oxidizing the water so that the oxygen is liberated, said cathodic compartment being suitable for electrochemically reducing said oxidized form of the compound so that said reduced form is regenerated.

Embodiments of the invention are described more in detail by way of example with reference to the accompanying drawings, in which.

Figure 1:
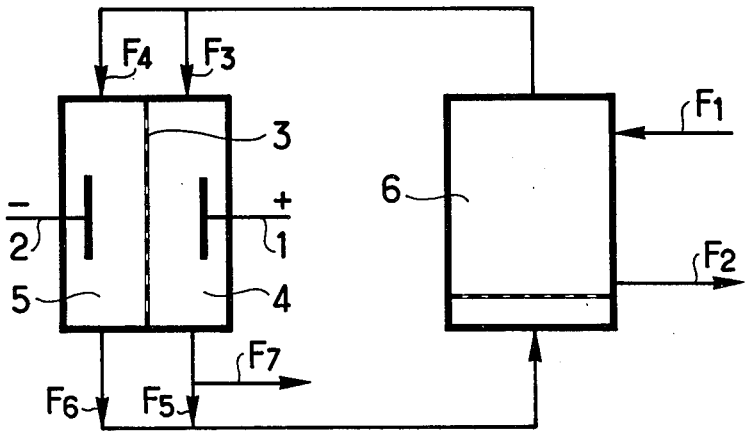
FIG. 1 shows schematically a device which allows an explanation of a first embodiment of the method according to the invention.

It is known that certain substances in their reduced form, and in particular derivatives of anthraquinone and alkylanthraquinone, react with the oxygen of the air to yield a particularly oxidizing form of peroxide which gives rise spontaneously, under certain pH conditions, to the production of hydrogen peroxide or of water and an oxidized form, by decomposition.

Further anthraquinone derivatives are particularly easy to reduce electrochemically.

The applicant consequently had the idea to use such substances in an electrolyzer in order to reduce their oxidized form which is subsequently peroxidized in a reactor where it spontaneously decomposes to an oxidized form and hydrogen peroxide or water, said hydrogen peroxide or water being capable of being electrochemically oxidized so that pure oxygen is liberated.

In a first embodiment of the invention a schematically shown electrolyzer (FIG. 1) contains an anode 1 and a cathode 2 which are separated by a semi-permeable membrane or diaphragm 3 defining an anodic compartment 4 and a cathodic compartment 5.

An oxidation reactor chamber 6 fed with air along arrow F1 contains a derivative capable of being peroxidized, for instance of the anthraquinone type such as anthraquinone 2–7 sodium or lithium disulfonate; the disulfonate can be one of another alkaline metal. The oxygen-poor air is removed from the reactor along the arrow F2.

Said reactor feeds anodic and cathodic compartments 4 and 5 of the electrolyzer along the arrows F3 and F4 respectively.

Further, arrows F5 and F6 indicate that the products leaving the anodic and cathodic compartments are sent back to the reactor, whereas arrow F7 indicates the evacuation of the oxygen produced by the electrolyzer. The electrolyte used is a neutral or slightly basic aqueous solution of said peroxidable derivative and of a buffer capable of maintaining the pH at a predetermined value between 7 and 10. Advantageously the buffer is a borate or a carbonate. The method according to this embodiment can be explained as follows:

In the reactor 6 the reduced form of the anthraquinone derivative coming along F6 from the cathodic compartment 5 of the electrolyzer reacts with the air feed in along F1 to yield a peroxide which spontaneously decomposes into water and the oxidized form of said anthraquinone derivative. These two latter substances are then fed along F3 and F4 respectively into the anodic compartment 4 and into the cathodic compartment 5. In the anodic compartment 4, the water is electrochemically oxidized liberating the oxygen which is then evacuated along F7.

In the cathodic compartment 5 said oxidized form is reduced. This reduced form is then directed to the reactor 6 along F6 and so on.

The following reactions illustrate the electrochemical process:

in the cathodic compartment 5:

oxidized form + $2e^- \rightarrow$ reduced form;

in the reactor:

reduced form + $\frac{1}{2} O_2$ + 2 BH $\rightarrow$ oxidized form + $H_2O$ + 2 $B^-$ ($B^-$ and BH being the basic and acid forms of the buffer in the solution);

in the anodic compartment:

$$H_2O + 2B^- \rightarrow \frac{1}{2} O_2 + 2\ BH.$$

In the second embodiment of the invention shown in FIG. 2 we find again the same elements as those used for the first embodiment.

However, in this second embodiment the reactor 6 feeds along F8 to a decomposition chamber 7 in which above all hydrogen peroxide is catalytically decomposed and which feeds the electrolyzer in the same manner as described with reference to FIG. 1.

The aqueous solution is a basic solution such as caustic potash lye with a pH value of about 14. The method according to this second embodiment of the invention can be explained as follows:

In the reactor 6, the reduced form of the anthraquinone derivative coming along F6 from the cathodic compartment 5 of the electrolyzer reacts with the air fed in along F1 to yield a peroxide which spontaneously decomposes into hydrogen peroxide and the oxidized form of the anthraquinone derivative. Both these latter substances are fed along F8 into the decomposition chamber 7 where the hydrogen peroxide is decomposed into oxygen and water. These products and the oxidized form are then directed along F3 and F4 respectively into the anodic compartment 4 and the cathodic compartment 5.

In the anodic compartment 4, the water is electrochemically oxidized yielding oxygen which is evacuated along F7 with the oxygen which formed in the chamber 7. In the cathodic compartment 5 said oxidized form is reduced. This reduced form is then directed to the reactor 6 along F6 and so on.

The following reactions illustrate the electrochemical process: in the cathodic compartment 5:

oxidized form + $2e^- \rightarrow$ reduced form;

in the reactor:

reduced form + $O_2$ + 2 BH $\rightarrow$ oxidized form + $H_2O_2$ + 2 $B^-$ ($B^-$ and BH are the basic and acid forms of the buffer in the solution); in the anodic compartment 4:

$$H_2O + 2\ B^- \rightarrow \frac{1}{2} O_2 + 2\ BH + 2\ e.$$

It goes without saying that in both embodiments of the invention the potential difference applied to the electrodes 1 and 2 of the electrolyzer is approximately equal to the difference between the oxidation reduction potential of the anthraquinone derivative and the potential of the electrochemical oxidation of water, i.e. about 1.3 V.

Figure 3:
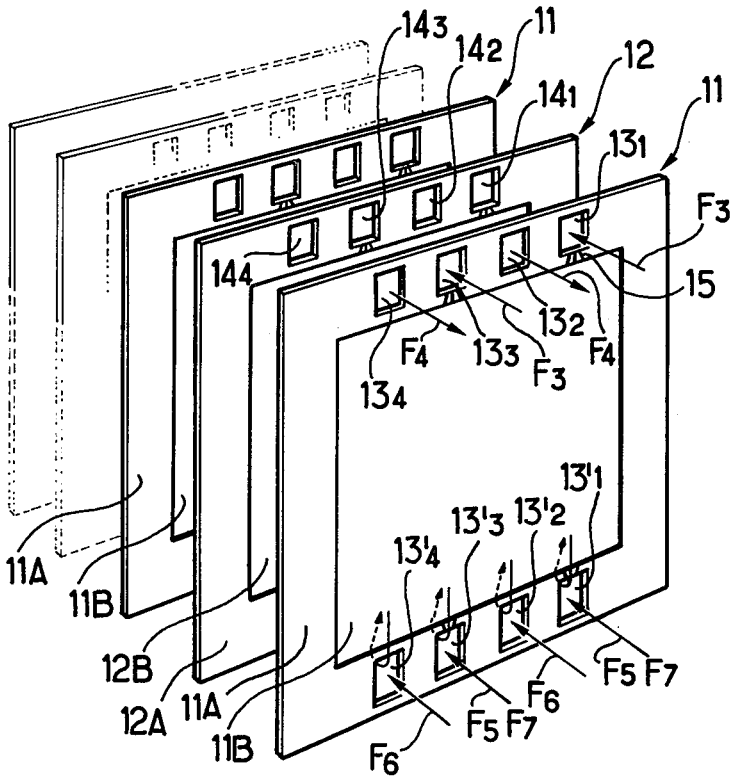
FIG. 3 is a partial perspective view of a device or electrolyzer of the filter-press type for applying the method of the invention.

FIG. 3 shows an electrolyzer of the filter-press type capable of using the method of the invention. Such an electrolyzer is composed of a plurality of components of substantially identical dimensions, i.e. a bipolar electrode 11, a bipolar separator or diaphragm 12, a bipolar electrode 11 and so on.

Each of these components is in the form of a frame 11 A, 12 A enclosing a central part 11 B, 12 B.

One of the sides of each bipolar electrode, for instance the side visible in FIG. 3, plays the role of the anode, whereas the other side constitutes the cathode. Said sides may advantageously contain catalytic compounds specific for the reactions taking place in contact with them.

The frames 11A, 12A have upper openings **13*i*, 14*i* and lower openings 13'*i*, 14'*i*** ($i$ = 1, 2, 3. . .) forming channels when the components are stacked one against the other for assembling into a filter-press type block.

Figure 2:
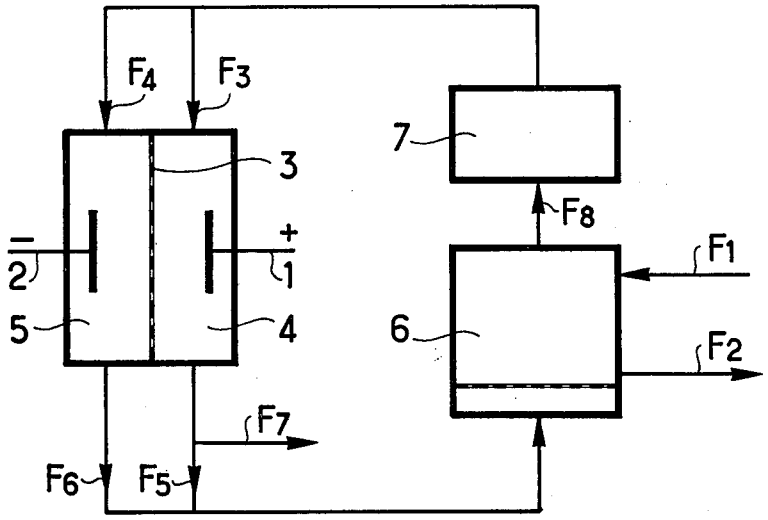
FIG. 2 shows schematically a device which allows an explanation of a second embodiment of the method according to the invention.

Thus the openings $\mathbf{13}_1$ and $\mathbf{13}_3$ of the electrodes 11 ensure the irrigation of the anodic sides (arrow F3, FIGS. 1 and 2), while the openings $\mathbf{13'}_1$ and $\mathbf{13'}_3$ serve to transfer the products originating from the anodic faces of the electrodes (arrows F5, FIGS. 1 and 2) and the liberated oxygen to the exterior (arrow F7, FIGS. 1 and 2).

As to the openings $\mathbf{13}_2$ and $\mathbf{13}_4$, their role is to wash the cathodic sides (arrow F4, FIG. 1), while the openings $\mathbf{13'}_2$ and $\mathbf{13'}_4$ ensure the evacuation of the compounds coming from the cathodic sides (arrows F6, FIGS. 1 and 2). The linking up of the above openings with the corresponding side is, for instance, effected by means of micro-channels such as 15.

The method and the device as described thus enable very pure oxygen to be obtained with a minimal consumption of electric energy, and provides oxygen exclusively without liberating secondary elements, such as hydrogen whose presence always represents a risk in spite of strictly observed safety precautions.

This very pure oxygen can advantageously be used for purifying used water, or more precisely speaking for its aerobic biological treatment.

Of course, the invention is in no way limited to the embodiments described hereinabove which are to be considered only as examples.

It is, in particular, possible, within the scope of the invention, to add modifications of details, change certain positions or replace certain means by equivalent ones.

Likewise, it is obvious that compounds other than derivatives of anthraquinone can be used in the scope of the invention, provided the other compounds are able to yield hydrogen peroxide and to reoxide when brought into contact with the air.

What we claim is:

1. An electrochemical method for producing oxygen in a cell containing an anode compartment and a cathode compartment comprising reacting air with the reduced form of a compound in a slightly basic medium having a pH value of 7 to 10 in a reactor to obtain a peroxide which spontaneously decomposes into a mixture of water and the oxidized form of the compound;

electrochemically oxidizing a portion of said mixture in the anode compartment whereby the water is oxidized to form oxygen which is then recovered;

electrochemically reducing another portion of said mixture in the cathode compartment whereby said oxidized form of said compound is reduced to regenerate said reduced form of said compound; and recycling said reduced form of said compound to be reacted with air.

2. Method according to claim 1, wherein said compound is an anthraquinone derivative.

3. Method according to claim 2, wherein said compound is the anthraquinone 2-7 disulphonate of an alkali metal compound.

4. Method according to claim 3 wherein said alkali metal is selected from the group consisting of sodium and lithium.

5. Method according to claim 4 wherein said basic medium having a pH of 7–10 contains buffer ions selected from the group consisting of borate and carbonate.

6. Method according to claim 5 wherein said compound is the anthraquinone to 2–7 disulphenate of an alkali metal.

7. Method according to claim 6 wherein said alkali metal is selected from the group consisting of sodium and lithium.

8. Method according to claim 7 wherein said basic medium having a pH of about 14 contains potassium hydroxide.

9. Method according to claim 1, wherein said basic medium is an aqueous solution of an alkali hydroxide.

10. Method according to claim 1, wherein said electrochemical oxidation and reduction are effected at a potential difference equal to the difference between the oxidation-reduction potential of said compound and the potential of the electrochemical oxidation of water.

11. An electrochemical method for producing oxygen in a cell containing an anode compartment and a cathode compartment comprising reacting air with the reduced form of a compound in a basic medium having a pH value of about 14 in a reactor to obtain a peroxide which spontaneously decomposes into hydrogen peroxide and the oxidized form of the compound decomposing said hydrogen peroxide into a mixture comprising water, oxygen, and said oxidized form of said compound;

electrochemically oxidizing a portion of said mixture in the anode compartment whereby the water is oxidized to form oxygen which is then recovered;

electrochemically reducing another portion of said mixture in the cathode compartment whereby said oxidized form of said compound is reduced to regenerate said reduced form of said compound; and recycling said reduced form of said compound to be reacted with air.

12. Method according to claim 11 wherein said basic medium is an aqueous solution of an alkali hydroxide.

13. Method according to claim 12 wherein said electrochemical oxidation and reduction are effected at a potential difference equal to the difference between the oxidation-reduction potential of said compound and the potential of the electrochemical oxidation of water.

14. Method according to claim 11 wherein said compound is an anthraquinone derivative.

* * * * *